United States Patent [19]

McKinnon

[11] Patent Number: 4,929,199

[45] Date of Patent: May 29, 1990

[54] BATTERY CABLE CLIP AND CABLE CONNECTION

[75] Inventor: Donald C. McKinnon, Cheboygan, Mich.

[73] Assignee: Ferret, Cheboygan, Mich.

[21] Appl. No.: 218,135

[22] Filed: Jul. 13, 1988

[51] Int. Cl.[5] ..... H01R 4/48

[52] U.S. Cl. ..... 439/759; 439/437; 439/452; 439/455; 439/504; 439/829

[58] Field of Search ..... 439/754, 757, 759, 760, 439/504, 452, 457, 456, 467, 472, 828, 829, 437; 174/65 G

[56] References Cited

U.S. PATENT DOCUMENTS

| | | | |
|---|---|---|---|
| 1,366,799 | 1/1921 | Hartung | 439/829 |
| 1,422,765 | 7/1922 | Johnson | 439/822 |
| 1,615,106 | 1/1927 | Bethea | 439/757 |
| 1,651,294 | 11/1927 | Rumore | 439/759 |
| 2,398,002 | 4/1946 | Heyman | 439/455 |
| 2,714,198 | 7/1955 | Schloetzer | 339/261 |
| 3,248,495 | 4/1966 | Kastel | 439/822 |
| 3,821,689 | 6/1974 | Graham | 439/829 |
| 4,133,971 | 1/1979 | Boyd et al. | 439/452 |
| 4,153,321 | 5/1979 | Pombrol | 439/437 |
| 4,256,361 | 3/1981 | Bell | 339/228 |
| 4,345,807 | 8/1982 | Shekel et al. | 439/759 |
| 4,377,317 | 3/1983 | Shekel et al. | 339/29 B |
| 4,565,414 | 1/1986 | French | 439/829 |
| 4,620,767 | 11/1986 | Woolf | 439/504 |
| 4,685,760 | 8/1987 | Mize | 439/829 |

*Primary Examiner*—P. Austin Bradley

*Attorney, Agent, or Firm*—Price, Heneveld, Cooper, DeWitt & Litton

[57] ABSTRACT

A cable clip includes a strain relief bushing positioned between the jaws of the clip and the handle end for anchoring a cable to the clip in orthogonal relationship to the clip with the bend in the cable confined to the inside of the clip.

4 Claims, 1 Drawing Sheet

BATTERY CABLE CLIP AND CABLE CONNECTION

BACKGROUND OF THE INVENTION

The present invention pertains to a cable clip and particularly a heavy-duty cable clip and attachment to a heavy gauge wire.

Cable clips used for temporary connections to vehicle batteries can be found on battery testers, jump start cables, and battery chargers. Usually when heavy gauge stranded wire such as 4 A.S.W.G. wire is connected to a clip, it extends along one leg of the clip with its terminal end coupled to the jaws of the cable clip and in some fashion crimped or otherwise fastened to the end of the clip remote from the jaws to hold the cable in place. When such a clip is attached to the battery terminal, typically it is positioned such that the clip is in its generally vertical position. The weight of the heavy gauge wire itself and/or the stress on the wire by the all too frequently short interconnection length of jumper cables, for example, tend to twist the clip from its clamping position which can cause serious shorting and even result in a fire hazard. Also, the bend at the junction of the cable clip and the wire when so installed tends, over a period of time, to fatigue the wire or at least break the insulation near the cable clip.

SUMMARY OF THE PRESENT INVENTION

The cable clip of the present invention overcomes the deficiencies of such prior art cable clips by coupling the wire mechanically through the side of the one leg of the cable clip through a strain relief device such that it extends into the cable clip orthogonally to the general longitudinal axis of the clip. The end is then terminated into a contact jaw such that when the clip is placed on a battery terminal either in a conventional upright, generally vertical position or in a side position, any strain on the connection to the terminal will be minimized due to the reduced distance between the contact jaw and the mechanical cable connection to the clip. The bend of the cable is permanently confined within the structure of the clip itself; therefore, no flexing of the cable takes place at the bend. This results in a more conveniently usable, and durable, and electrically insulated cable clip which is safe and effective. These and other features, objects and advantages of the invention can best be understood with reference to the following description thereof together with reference to the accompanying drawings in which:

DETAILED DESCRIPTION OF THE PREFERRED EMBODIMENT

Figure 1:
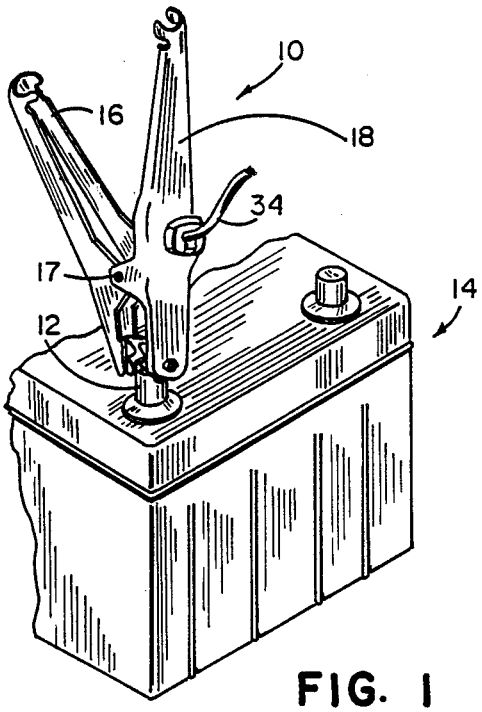
FIG. 1 is a fragmentary perspective view of a cable clip embodying the present invention shown attached to a battery.
Figure 2:
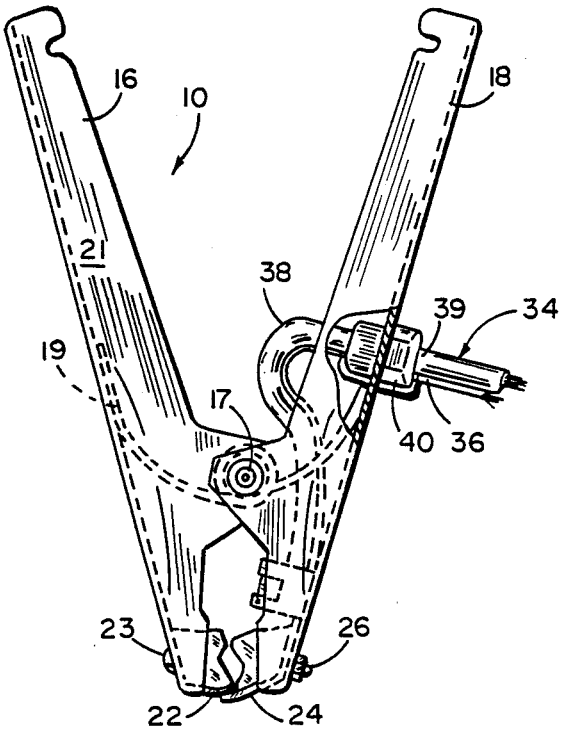
FIG. 2 is a fragmentary, partly broken away, side elevational view of the cable clip embodying the present invention.

Referring initially to FIG. 1, there is shown a battery cable clip 10 embodying the present invention and shown attached to one post-type terminal 12 of a typical battery 14 used in a vehicle. The battery clip 10 comprises first and second steel legs 16 and 18, respectively, which are pivotally coupled together by a pivot member 17 which includes a coil spring 19 (FIG. 2) to hold the jaws of the clip in a closed position as illustrated in FIGS. 1 and 2. Spring 19 surrounds pivot pin 17 and includes legs extending on the inside of the legs 16 and 18 of clip 10 in a conventional manner. Legs 16 and 18 in the preferred embodiment of the invention are coated with a suitable insulating polymeric material 21 such as vinyl for insulating the cable clip legs.

Figure 3:
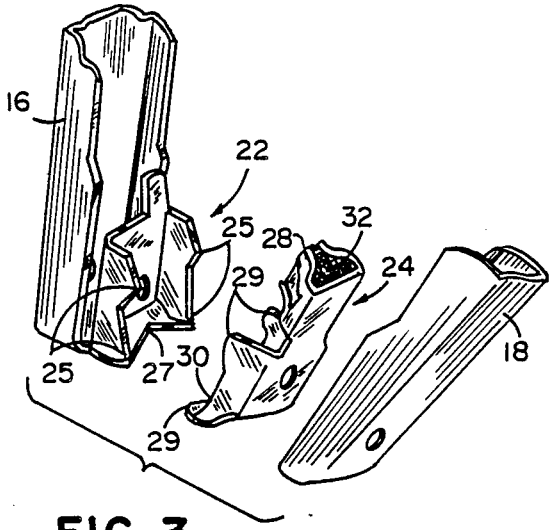
FIG. 3 is an enlarged fragmentary exploded view of the jaws of the cable clip of the present invention.
Figure 4:
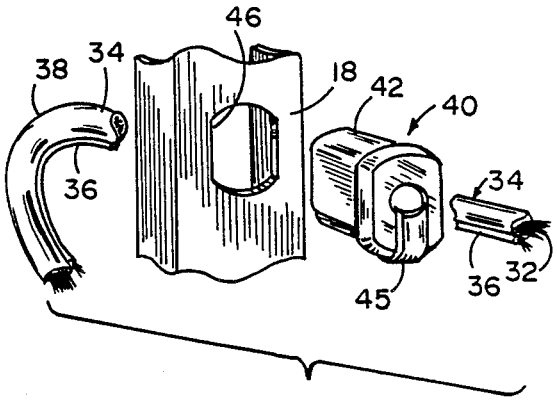
FIG. 4 is an enlarged fragmentary exploded view of the interconnection of the cable to the cable clip.

A first conductive jaw member 22 is coupled to the tip of leg 16 of clip 10 by means of a rivet 23 (FIG. 2) and includes a plurality of ridges 25 (FIG. 3) defining therebetween grooves 27 for surrounding the generally cylindrical battery terminal 12 of battery 14 or to other types of battery terminals. A second jaw 24 is secured to the lower tip of leg 18 of clip 10 by means of a fastener such as a bolt 26 (FIG. 2) and includes an integral crimp-on connector 28 at the end remote from the jaw ridges 29 also defining a trough 30 therebetween for partially circumscribing the cylindrical terminals 12 of battery 14. As seen in FIG. 3, the stranded copper conductors 32 of a cable 34 (FIGS. 1, 2 and 4) is crimped within the end 28 of jaw member 24 for making the mechanical and electrical connection to the end of cable 34 to jaw 24. A secondary conductor 36 may also be provided as illustrated in FIGS. 2 and 4 and similarly crimped within end 28 of jaw 24. Alternately, conductor 36 could be connected to jaw 22. Conductor 36 is a voltage sensing conductor which may be used in connection with a battery tester.

Conductors 34 and 36 are also mechanically coupled to one of the jaw members such as leg 18 by means of a strain relief bushing 40 having a keyed barrel 42 and an engaging side cap 45. The strain relief 40 is of conventional design and fits in a lockable fashion within a keyed aperture 46 formed in leg 18 of clip 10 once cable conductors 34 and 36 are extended through the strain relief bushing 40. Conductors 34 and 36 are then permanently bent at 38 within the confines of the legs 16 and 18 of the clip with the terminal end of conductor 34 mechanically anchored by jaw member 24 and the opposite side of bend 38 permanently anchored mechanically at 39 by bushing 40. Thus, the bend 38 in the conductor remains stationary during use of the cable clip.

By positioning aperture 46 approximately midway between the jaw end of clip 10 and the opposite end of the leg defining handles of the clip, the distance between the jaws and cable is reduced. Therefore, any strain on the cable tends to produce less of a bending moment tending to reduce the possibility that any strain on the cable will tear the cable clip from the battery terminal 12. The utilization of the orthogonally extending strain relieved cable connection to the clip 10, thus, provides a more convenient and usable clip.

In the preferred embodiment of the invention, cable 34 is a 4-gage insulated cable while the strain relief fitting 40 was commercially available. Conductive jaws 22 and 24 were copper.

It will become apparent to those skilled in the art that various modifications to the preferred embodiment can be made without departing from the spirit or scope of the invention as defined by the appended claims.

The embodiment of the invention in which an exclusive property or privilege is claimed are defined as follows:

1. An automobile battery clip comprising:

a pair of substantially identical legs;

a pivot member joining said pair of legs;

a spring positioned about said pivot member and extending away from the pivot member toward the end of each of said pair of legs, which form a handle, to force the two opposite ends of said pair of legs into tight contact;

a pair of co-acting jaws fastened on the inner surface of the contacting ends of said legs with one jaw being connected to each of said legs so that said pair of jaws is normally biased in a tightly closed condition;

a cable clamp on one jaw of said pair of jaws; and a heavy electrical conductor having one end held by said cable clamp and extending away from said clamp along the inside of one of said legs to an aperture formed in said leg approximately midway between the ends of said leg where said heavy electrical conductor is bent at approximately a 90° angle to pass through the aperture in a direction substantially orthogonal to the longitudinal axis of said leg.

2. An automobile battery clip as set forth in claim 1, wherein a strain relief is mounted in the aperture formed in said leg and about said heavy electrical conductor.

3. An automobile battery clip as set forth in claim 1, wherein said heavy electrical conductor exits through the aperture formed in one leg below the handle of said battery clip.

4. An automobile battery clip as set forth in claim 1, wherein said heavy electrical conductor is bent within the handle and exits through the aperture formed in said leg above the pivot member and below the handle.

* * * * *

UNITED STATES PATENT AND TRADEMARK OFFICE

CERTIFICATE OF CORRECTION

PATENT NO. : 4,929,199

DATED : May 29, 1990

INVENTOR(S) : Donald C. McKinnon

It is certified that error appears in the above-identified patent and that said Letters Patent is hereby corrected as shown below:

Column 1, line 20:
after "stress" insert --placed--.

Signed and Sealed this

Seventh Day of January, 1992

*Attest:*

HARRY F. MANBECK, JR.

*Attesting Officer*

*Commissioner of Patents and Trademarks*